US006434998B2

(12) United States Patent
Amherd

(10) Patent No.: US 6,434,998 B2
(45) Date of Patent: Aug. 20, 2002

(54) PRESSING PINCER

(75) Inventor: René Amherd, Reutlingen (CH)

(73) Assignee: Von Arx AG, Sissach (CH)

( * ) Notice: Subject to any disclaimer, the term of this patent is extended or adjusted under 35 U.S.C. 154(b) by 0 days.

(21) Appl. No.: 09/756,544

(22) Filed: Jan. 8, 2001

(30) Foreign Application Priority Data

Jan. 7, 2000 (CH) ..... 27/00

(51) Int. Cl.[7] ..... B21D 41/04

(52) U.S. Cl. ..... 72/416; 72/407; 72/453.16; 29/237

(58) Field of Search ..... 72/453.16, 453.15, 72/416, 409.19, 409.01, 409.1, 407; 29/237, 751

(56) References Cited

U.S. PATENT DOCUMENTS 2,253,906 A * 8/1941 Lehman
2,359,696 A * 10/1944 Turtle
2,684,004 A * 7/1954 Holtzapple
3,120,772 A * 2/1964 Mixon
3,323,346 A * 6/1967 Spangler
4,483,056 A * 11/1984 Schwalm ..... 29/237
5,611,228 A 3/1997 Dummermuth
5,839,316 A * 11/1998 Kolivoski ..... 72/463.16
6,035,775 A * 3/2000 Ngheim ..... 29/237
6,164,106 A * 12/2000 Nghiem ..... 72/416
6,244,085 B1 * 6/2001 Dummermuth ..... 72/416

FOREIGN PATENT DOCUMENTS

DE 196 31 019 8/1997

* cited by examiner

*Primary Examiner*—Daniel C. Crane
(74) *Attorney, Agent, or Firm*—Pauley Petersen Kinne & Erickson

(57) ABSTRACT

A pressing apparatus with an associated, exchangeable pressing tool. The pressing apparatus has a drive unit and a connection unit for connection to a pressing pincer. The connection unit has two holding plates. The pressing pincer with its two T-shaped carrier plates is inserted between the holding plates. A connection bolt is pushed through the holding plates and a receiving opening on the T-shaped carrier plates and is secured. The pressing apparatus is thus ready for use. The pressing pincer with an actuation bears with its two pivot arms on bearing surfaces on the apparatus. With a further retraction of the pressing pincer the pivot arms are pushed out laterally and thus the pressing is undergone.

4 Claims, 2 Drawing Sheets

PRESSING PINCER

BACKGROUND OF THE INVENTION

1. Field of the Invention

This invention relates to a pressing pincer for a pressing apparatus for connecting a tube section to a press fitting, having two T-shaped carrier plates between two pivot arms.

2. Description of Related Art

From German Patent Reference DE 196 31 019 there is known a pressing apparatus which has a pressing pincer for connecting a tube to a press fitting. The pressing pincer has two pivot arms and in each one bolt is pivotably linked between two equal T-shaped carrier plates. The pivot arms at one end have a bearing surface for the bearing on a pressing cylinder of the pressing apparatus. On the oppositely lying end the pivot arms are configured as pressing surfaces directed to one another. The linkings for the bolts are located on the carrier plates, at a distance. In the region of the free end of the T-shaped carrier plates there is located a receiver of a connection bolt, for connection to the pressing apparatus. With this apparatus the pressing pincer is pulled to the rear to the pressing apparatus. At the same time the pivot arms slide with their bearing surfaces to the rear along bearing surfaces on the pressing apparatus. The pulling force is transmitted to the T-shaped carrier plates via the connection bolts. Thus the pivot arms pivot about the bearing bolt and the pressing jaws are moved against one another and pressed together. One disadvantage of this pressing pincer is that the pivot jaws are freely pivotable about the bearing bolts with respect to the T-shaped carrier plates. Thus the pivot jaws may be displaced mutually longitudinally by a certain amount. This has the effect that at the beginning of a pressing the clamping jaws and thus the actual clamping surface may be mutually displaced somewhat in the longitudinal direction. This results in an inexact pressing of the fittings to the tube. Furthermore there is a danger that the fitting and/or the tube at the beginning of the pressing are so damaged that a sealing connection is not guaranteed.

SUMMARY OF THE INVENTION

It is one object of this invention to provide a pressing pincer of the mentioned type, which prevents an inaccurate beginning of the pressing and which overcomes the disadvantages thus arising.

This object is achieved by this invention as specified in the specification and in the claims.

BRIEF DESCRIPTION OF THE DRAWINGS

This invention is described in combination with the drawings, wherein.

DESCRIPTION OF PREFERRED EMBODIMENTS

Figure 1:
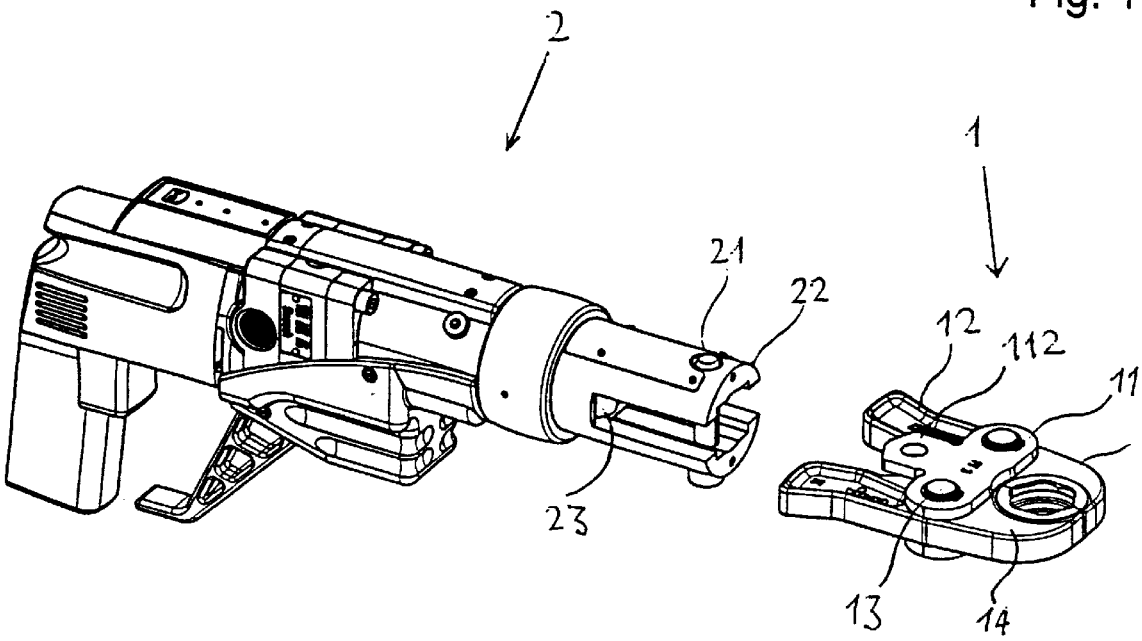
FIG. 1 is a perspective view of a pressing apparatus with a pressing pincer, according to this invention.

FIG. 1 shows a pressing apparatus with the associated exchangeable pressing pincer, in a perspective top view. The pressing apparatus 2 comprises a drive unit and a connection unit for connection to a pressing pincer 1. The connection unit comprises two holding plates 22. The pressing pincer 1 with two T-shaped carrier plates 11, 11' is inserted between the holding plates 22. A connection bolt 21 is pushed through the holding plates and a receiver opening 112 on the T-shaped carrier plates 11, 11' and is secured. The pressing apparatus 2 is thus ready for use. The pressing pincer 1 then on actuation, with the two pivot arms 12 bears on the bearing surfaces 23 on the pressing apparatus 2. With a further retraction of the pressing pincer 1 the pivot arms 12 are pushed laterally outwards and thus the pressing is undergone.

Figure 2:
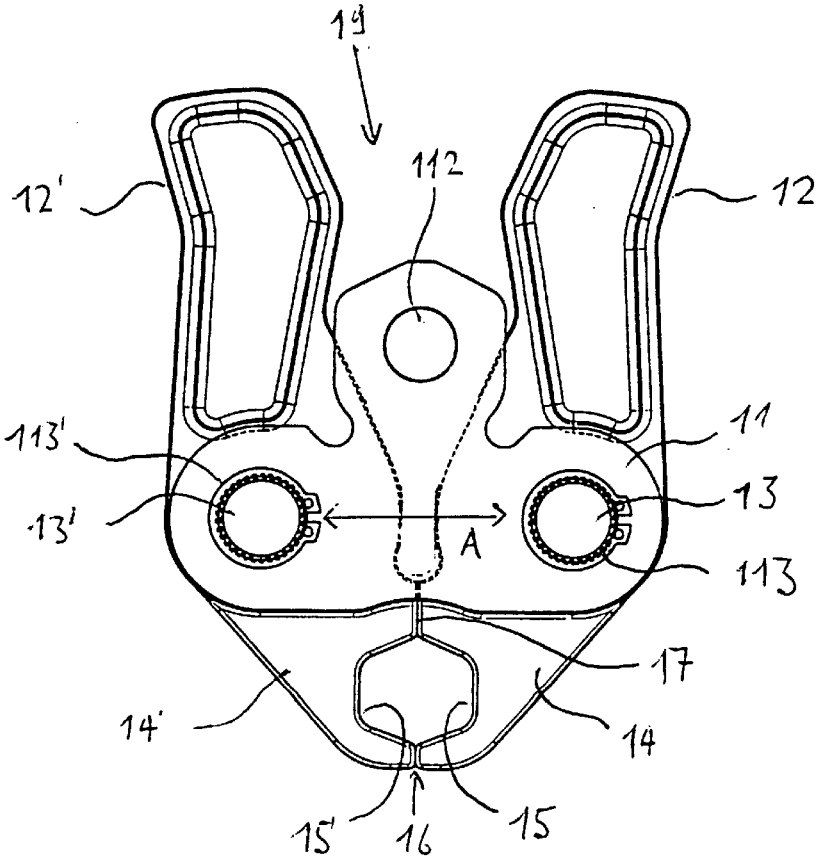
FIG. 2 is a top view of a pressing pincer according to the prior art.
Figure 4:
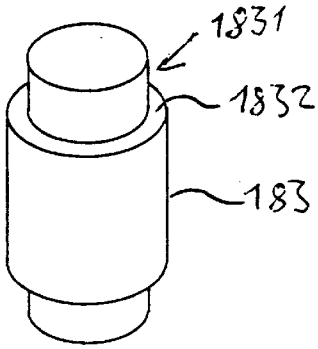
FIG. 4 is a perspective view of a particular embodiment of a centering bolt.

In FIG. 2 the pressing pincer 1 is shown in more detail. The pressing pincer 1 has two T-shaped carrier plates 11, 11'. The carrier plates 11, 11' on the bar piece laterally comprise in each case a bolt mounting 113, 113'. At the free end there is the receiver opening 112 for receiving the connection bolt 21. The pivot arms 12, 12' between the two T-shaped carrier plates 11, 11' are pivotably mounted in each case with one bearing bolt 13, 13' which is held in one of the bolt mountings 113, 113'. The pivot arms 12, 12' in the front part form clamping jaws 14, 14' which comprise pressing surfaces 15, 15' directed towards each other. The pressing surfaces 15, 15' in the closed condition of the pressing pincer 1 form an opening which approximately corresponds to the diameter of the tubes or connection muffs to be pressed. This opening is limited by front end-edges 16 and rear end-edges 17. In the closed condition the end-edges of both clamping jaws 14, 14' lie on one another. The bearing bolts 13 may be secured on the T-shaped carrier plates 11, 11' by way of securing rings 131.

According to this invention, both pivot arms 12, 12' by way of an active connection are connected so that compellingly they are uniformly and mutually pivotable. The active connection of the two pivot arms 12, 12' comprise dog elements which engage into one another with an approximately positive fit.

Figure 3:
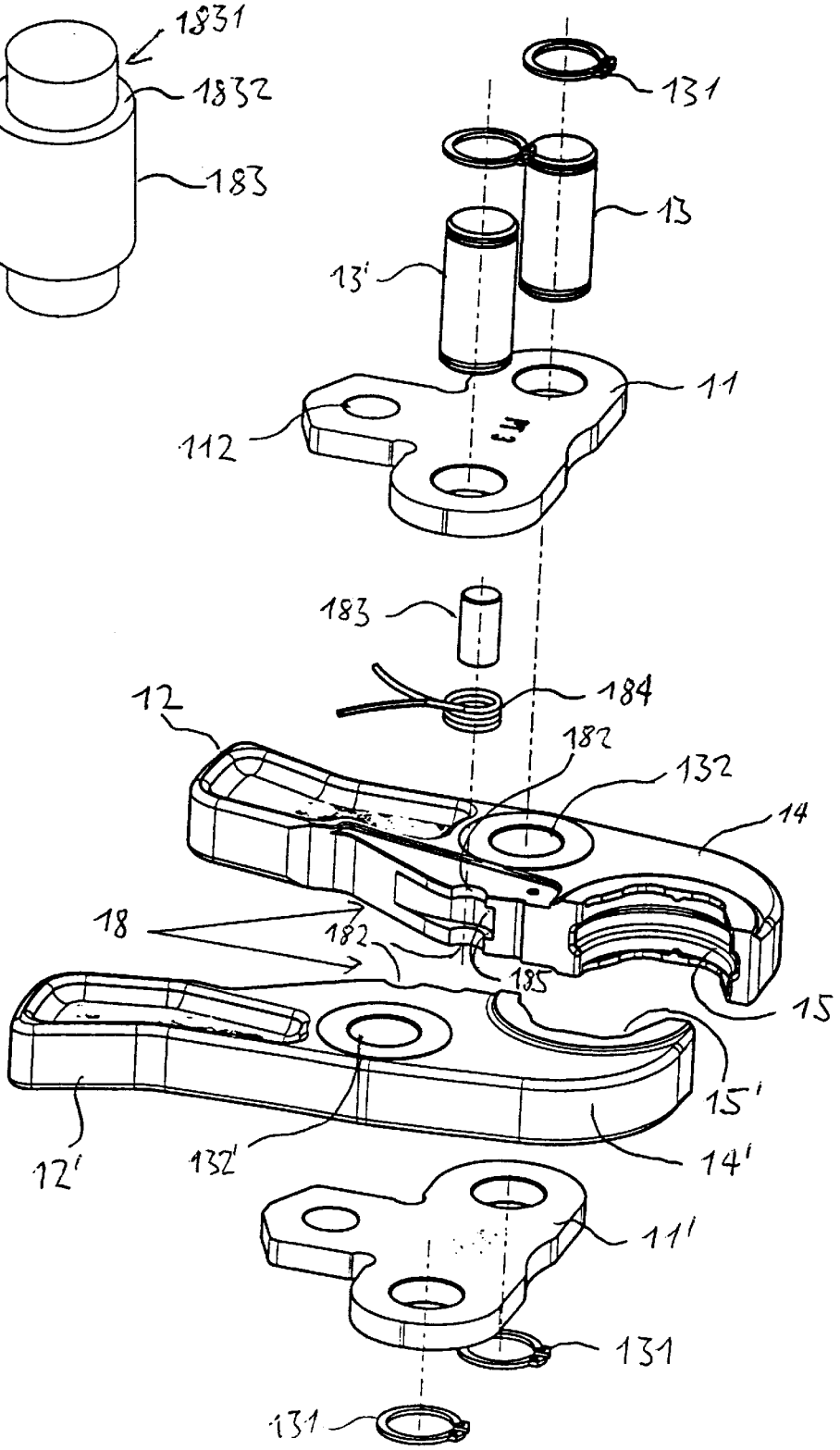
FIG. 3 is an exploded perspective view of a pressing pincer, according to this invention.

How the elements of the pressing pincer 1 are joined together is easily visible from the exploded drawing of FIG. 3. The pivot arms 12, 12', according to this invention, each have a bearing region 181, 181'. The bearing region 181, 181' is located roughly on an imagined connection line between the pivot bearings 132 through which the bearing bolts 13 are led. Each bearing region 181, 181' comprises half of the mounting for a guide bolt 183. The mounting comprises a bearing shell 182, 182' which embraces the guide bolts 183 in each case by less than half. This is necessary because the pivot arms 12, 12' on actuation are pivoted about the pivot bearing 132 and thus rotate somewhat about the guide bolt 183. Since the guide bolt 183 connects the two bearing regions 181, 181' and thus the pivot arms 12, 12' in a mutually rotatable manner, then compellingly both pivot arms 12, 12' are pivoted uniformly and in opposite directions. This means that the guide bolt 183 symmetrically guides the pivot movements of the pivot arms 12, 12'. Thus the clamping jaws 14, 14' with the pressing surfaces 15, 15' are likewise pivoted in an exactly symmetrical manner and each pressing is effected in an equally precise manner.

With the actuation of the pivot arms 12, 12', for reasons of geometry the guide bolt 183 with respect to the T-shaped carrier plates 11, 11' is displaced in the longitudinal direction X, as shown in FIG. 2, somewhat to the rear or to the front. Therefore it may not be rigidly connected to the carrier plates 11, 11'. The guide bolt 183 thus has end-surfaces which are as smooth as possible so that the guide bolt 183 may slide along on the inner surfaces of the T-shaped carrier plates 11, 11' with minimal friction. In one embodiment, the bearing regions 181, 181' have bolt guiding surfaces 185 between the bearing shells 182, 182', The guide bolt 183 has shoulders 1831 which form abutment surfaces 1832. The guide bolt 183 is rotatably held in the bearing shells 182, 182', wherein the guide bolt 183 with its abutments surfaces 1832 is guided by the bolt guiding surfaces 185 through abutments. The guide bolts 183 each is designed so short that in a bearing region it is perfectly held and with its end-face sides may not contact the inner surfaces of the T-shaped carrier plates 11, 11'.

A further improvement of the pressing pincer 1 is achieved by the application of a bracing spring 184. It is possible to configure the bracing spring 184 as a spiral spring which embraces the guide bolt 183 at least partly, preferably several times. The bracing spring 184 as a spiral spring of spring steel wire endures many loading cycles and tends to not break. Furthermore the bracing spring 184 on the guide bolt 183 is perfectly mounted and guided.

What is claimed is:

1. In a pressing pincer for a pressing apparatus for connecting a tube section to a press fitting, comprising: two pivot arms (12, 12') positioned between two T-shaped carrier plates (11), two bearing bolts (13, 13') arranged at a distance (A) from one another and each passing through one of the pivot arms (12, 12'), the pivot arms (12, 12') pivotably connected to the carrier plates (11), the pivot arms (12, 12') formed with clamping jaws (14, 14') having pressing surfaces (15, 15'), the two pivot arms (12, 12') each having a dog element with a bearing region (181, 181'), on the pivot arms (12, 12') between the bearing bolts (13, 13') the bearing regions (181, 181') lying opposite one another and at least partly formed as bearing shells (182, 182'), between the bearing regions (181, 181') a guide bolt (183) mounted in the bearing shells (182, 182'), and the guide bolt (183) rotatably movable with respect to the carrier plates (11) and displaceable in a longitudinal direction (X) which is perpendicular to a central axis of the guide bolt (183), and a spiral bracing spring (184) mounted between the two pivot arms (12, 12') and at least partly embracing the guide bolt (183).

2. In the pressing pincer according to claim 1, wherein an active connection of the two pivot arms (12, 12') comprises the dog elements which engage into one another in an approximately positive-fitting manner.

3. In the pressing pincer according to claim 1, wherein each of the bearing shell (182, 182') contacts the guide bolt (183) by less than one-half of a circumference of the guide bolt (183).

4. In the pressing pincer according to claim 1, wherein the bearing regions (181, 181') each has a bolt guide surface (185) and the guide bolt (183) comprises bearing surfaces (1832) which bear on the bolt guide surfaces (185).

* * * * *